US005881829A

United States Patent [19]

Dimond et al.

[11] Patent Number: 5,881,829

[45] Date of Patent: Mar. 16, 1999

[54] ROLLING-CUTTER MINING BIT WITH RELATIVELY SOFT FORMATION CUTTING STRUCTURE

[75] Inventors: Carl Edward Dimond, De Soto, Tex.; Benton Jay Buechler, Tucson, Ariz.

[73] Assignee: Baker Hughes Incorporated, Houston, Tex.

[21] Appl. No.: 895,185

[22] Filed: Jul. 16, 1997

[51] Int. Cl.[6] ..... E21B 10/00

[52] U.S. Cl. ..... 175/378; 175/431

[58] Field of Search ..... 175/425, 426, 175/428, 431, 378

[56] References Cited

U.S. PATENT DOCUMENTS

| | | | |
|---|---|---|---|
| 2,121,202 | 6/1938 | Killgore | 255/71 |
| 2,333,746 | 11/1943 | Scott et al. | 255/71 |
| 2,804,282 | 8/1957 | Spengler, Jr. | 255/345 |
| 3,126,067 | 3/1964 | Schumacher, Jr. | 175/374 |
| 3,306,669 | 2/1967 | Christensen et al. | 299/89 |
| 3,398,989 | 8/1968 | Christensen | 299/39 |
| 3,401,759 | 9/1968 | White | 175/341 |
| 3,858,670 | 1/1975 | Ott et al. | 175/374 |
| 3,952,815 | 4/1976 | Dysart | 175/374 |
| 4,047,583 | 9/1977 | Dyer | 175/374 X |
| 4,202,419 | 5/1980 | Youngblood | 175/374 |
| 5,372,210 | 12/1994 | Harrell | 175/431 |
| 5,479,997 | 1/1996 | Scott et al. | 175/374 |

*Primary Examiner*—Roger Schoeppel
*Attorney, Agent, or Firm*—James E. Bradley

[57] ABSTRACT

An earth-boring bit has a bit body with at least one bearing shaft depending inwardly and downwardly therefrom. A cutter is mounted for rotation on each bearing shaft and has a cutter shell surface and a plurality of cutting elements arranged on the shell surface in generally circumferential rows. At least one row of cutting elements includes at least one reduced-projection cutting element disposed between adjacent cutting elements. The row with the reduced-projection element is an inner row, but may include heel rows as well.

9 Claims, 1 Drawing Sheet

ROLLING-CUTTER MINING BIT WITH RELATIVELY SOFT FORMATION CUTTING STRUCTURE

BACKGROUND OF THE INVENTION

1. Field of the Invention

The present invention relates generally to earth-boring bits of the rolling cutter variety. More specifically, the present invention relates to the cutting structure of earth-boring bits of the rolling cutter for mining applications, principally drilling blast holes for recovery of minerals.

2. Background Information

Prior to the advent of the rolling-cone earth-boring bit, bores and boreholes in earthen formations typically were formed with a cable tool or a fixed-cutter drag bit. These early bits were little more than chisels forced into the earth by various means. By comparison the, original rolling-cone rock bit invented by Howard R. Hughes, U.S. Pat. No. 939,759, drilled the hard caprock at the Spindletop field near Beaumont, Tex. with relative ease. This rolling-cone bit was a near-essential part of the drilling and production of oil and gas wells that has propelled the energy industry.

Earth-boring or rock bits of the rolling-cutter variety are also useful in penetrating earthen formations for purposes other than the production of petroleum. These applications generally are referred to as "mining" applications. A principal mining application for mining bits is the drilling of blast holes. Blast holes are relatively shallow (compared to those drilled for production of petroleum) holes in the earth that are used for a variety of purposes, but primarily to insert explosives into the earth for opening subterranean mine cavities.

Rock bits employed in drilling for petroleum generally are run until they are effectively destroyed. Rock bits employed in mining applications generally are not, and may be used to bore or drill more than one hole. Generally, the equipment employed in oil and gas well drilling is more expensive and more expensive to operate than that used in mining operations. Thus, there is a perception that the operational life of a rolling-cone rock bit employed in petroleum drilling applications is a more critical factor than the life of a rock bit employed in mining applications.

Nevertheless, the basic measure of the performance of a rolling-cone rock bit, whether for mining or petroleum drilling applications, is its rate of penetration of earthen formations. A bit that has a long operational life, but drills slowly, has a poor penetration rate, as does a bit that drills quickly, but has a short operational life. Thus, penetration rate measures both the durability and the drilling efficiency of a rock bit.

Many factors affect the penetration rate of a rock bit. One of these factors is the bit's cutting structure, which includes the configuration and arrangement of cutting elements or teeth on the cutters of the bit. For example, bits having steel teeth, milled or formed from the material of the cutter, have generally good toughness and sharpness and are thus useful in drilling relatively soft formations such as clays, shales, soft sandstones and limestones.

For increased durability, the cutting elements are also formed of hard metal inserts or compacts, usually sintered tungsten carbide, which are interference fit or otherwise secured into apertures in the cutter. These carbide cutting elements are more blunt and have lower projections than steel teeth, and thus are adapted for drilling harder formations such as metal ores and igneous rocks.

Even when soft formations are expected, the bit will almost surely encounter hard formation streaks. The cutting structure of a relatively long and sharp-toothed bit can be seriously damaged or destroyed when hard streaks are encountered for any significant period of time. Such damage can adversely affect the penetration rate of the bit even when it encounters soft formations again. Bits having blunter, more durable cutting structures can be used where hard streaks are expected, but the loss of penetration rate through soft material can be significant and adverse.

In addition to the composition of the cutting elements, their individual configurations and arrangement on each cutter can influence the penetration rate of a bit in different types of formation and combination of formations. There is a near-constant need for improvements to the cutting structure of earth-boring bits, for both mining and petroleum drilling applications.

SUMMARY OF THE INVENTION

It is a general object of the present invention to provide an earth-boring bit of the rolling-cutter variety having an improved cutting structure. This and other objects of the present invention are achieved by providing a bit body having at least one bearing shaft depending inwardly and downwardly therefrom. A cutter is mounted for rotation on each bearing shaft and has a cutter shell surface and a plurality of cutting elements arranged on the shell surface in generally circumferential rows. At least one row of cutting elements includes at least one reduced-projection cutting element disposed between adjacent cutting elements. The row with the reduced-projection element is an inner row, but may include heel rows as well.

According to the preferred embodiment of the present invention, a reduced-projection element alternates with conventional elements in each inner and heel row of each cutter.

According to the preferred embodiment of the present invention, the conventional and reduced-projection elements are in one row, axisymmetric or conical in configuration.

According to the preferred embodiment of the present invention, the cutting elements are formed of hard metal and are secured by interference fit in apertures in the cutter.

Other objects, features, and advantages of the present invention become apparent with reference to the figures and detailed description, which follow.

DESCRIPTION OF THE PREFERRED EMBODIMENT

Figure 1:
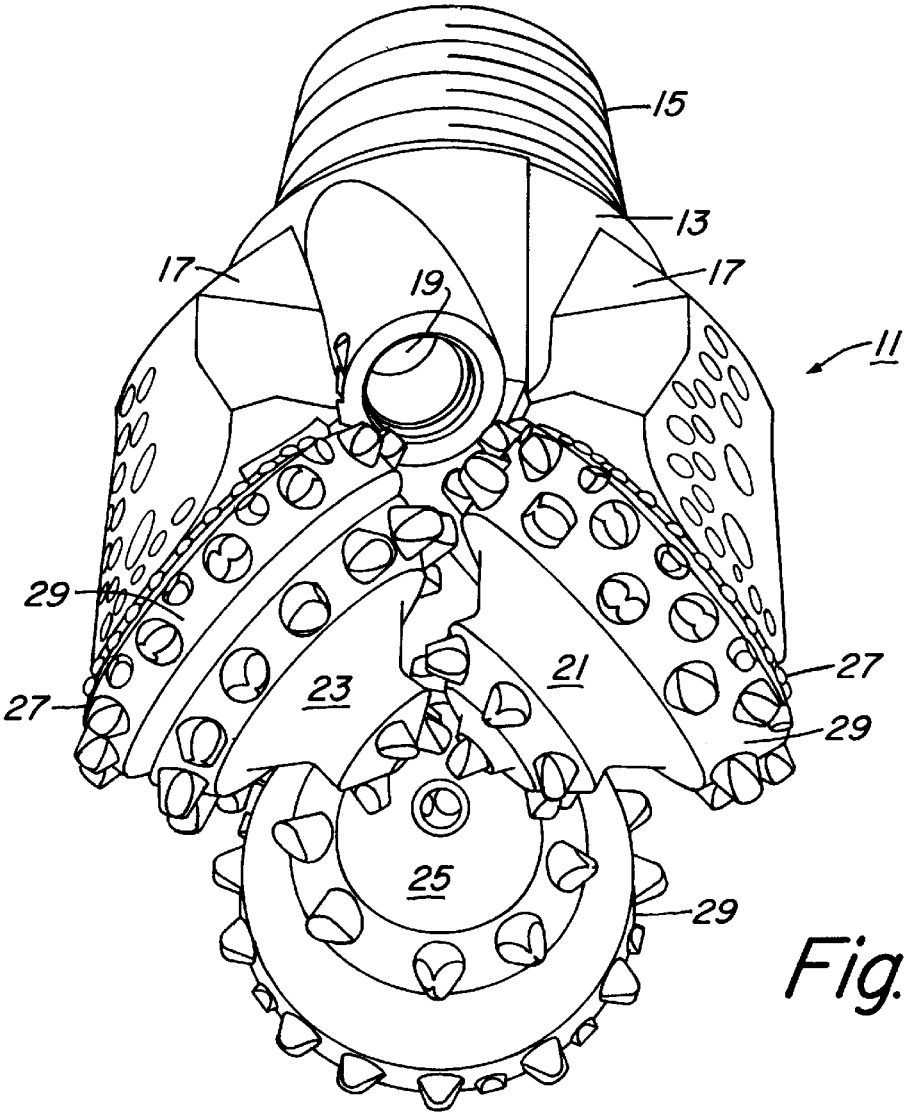
FIG. 1 is a perspective view, looking upwardly toward the cutters, of an earth-boring bit according to the present invention.

FIG. 1 is a perspective view of an earth-boring bit 11 according to the preferred embodiment of the present invention. Bit 11 has a bit body 13, which is threaded at its upper extent 15 for connection into a drillstring. Two or preferably three bit legs 17 depend downwardly from bit body 13. At least one nozzle 19 is provided in bit body 13 to deliver a stream of drilling fluid (usually air in mining applications) to the bottom of the borehole to cool bit 11 and to carry cuttings up the borehole. A bearing shaft (not shown) depends inwardly and downwardly from each bit leg 17 and bit body 13.

A generally frusto-conical cutter 21, 23, 25 is mounted for rotation on each bearing shaft. Each cutter 21, 23, 25 is conventionally offset such that its axis of rotation does not coincide with the geometric center of bit 11. Offset cutters slide as well as roll over the bottom of the borehole.

Each cutter 21, 23, 25 has a cutter shell surface that includes an outermost or gage surface 27 and a heel surface 29 that is just inward of gage surface 27. A plurality of cutting elements, preferably hard metal inserts or compacts, are arranged in circumferential rows on each cutter 21, 23, 25. The circumferential rows include a gage row of elements on gage surfaces 27, and a heel row of elements on heel surfaces 29, and inner rows that are inward of the heel row. The cutting elements in the heel row (on heel surface 27) are configured and arranged as disclosed in commonly assigned U.S. application Ser. No. 08/693,556, now U.S. Pat. No. 5,697,462.

Figure 2:
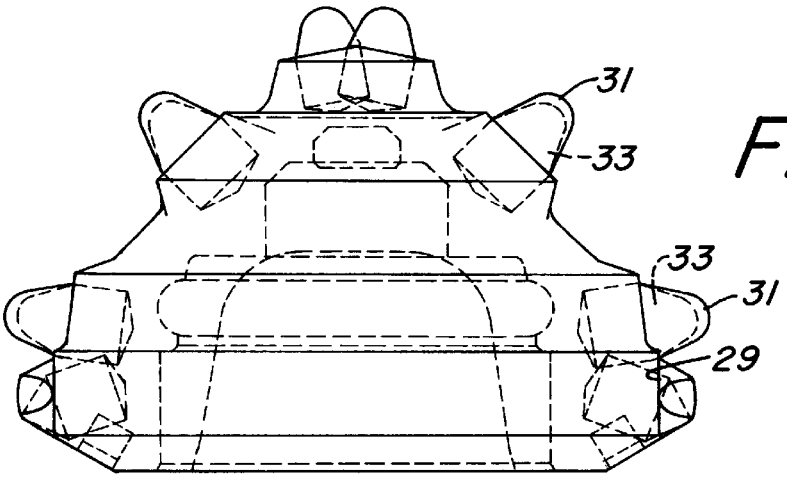
FIG. 2 is an elevation view of a single cutter of the earth-boring bit of FIG. 1.

FIG. 2 is an elevation view of a cutter 21 according to the preferred embodiment of the present invention. As is illustrated, the inner rows of cutting elements or inserts (those rows inward on the cutter from the heel row of inserts on heel surface 29) are comprised of conical, ovoid, or other axisymmetric inserts or cutting elements 31, 33. According to the preferred embodiment of the present invention, a reduced-projection insert 33 (shown in phantom in FIG. 2) is disposed between adjacent pairs of conventional-projection inserts 31. For example, for a 10-⅝ inch bit conventional-projection inserts 31 are designed for penetrating soft formations and have projections of between 0.485 and 0.600 inch, depending on the row. Conventional-projection inserts 33 are also provided with a conventional, wide pitch (angular distance between adjacent inserts) for relatively soft formations. Reduced-projection inserts 33 are evenly spaced between conventional inserts 31 and have been found not to reduce the soft formation penetration rate of the conventional cutting structure appreciably. Reduced-projection inserts 33 do increase the penetration rate of the bit through hard streaks appreciably compared to conventional structure alone. Reduced-projection inserts 33 have projections of between 0.300 and 0.480 inch, depending on the row, and preferably project from the surface or land about 60%–80% of the projection of conventional-projection inserts 31.

In operation, bit 11 is coupled into a drillstring, and is rotated such that cutters 21, 23, 25 roll and slide over the bottom of the borehole. The action of cutters 21, 23, 25 and cutting elements or inserts on the bottom of the borehole crushes, shears, and otherwise dislodges formation material, which is carried up the annulus between the drillstring and the borehole wall. Conventional inserts or elements 31, which are designed to gouge formation material, maintain an acceptable penetration rate through soft formation materials. When a hard or abrasive streak is encountered, reduced projection inserts or elements 33 aid elements 31 in crushing formation material and assist in preventing breakage or loss of conventional projection inserts or elements 31.

The present invention is described with reference to a preferred embodiment thereof. It is not limited, but is thus susceptible to variation and modification without departing from the scope of the invention.

I claim:

1. An earth-boring bit comprising:

a bit body;

at least one bearing shaft depending inwardly and downwardly from the bit body;

a cutter mounted for rotation on each bearing shaft, the cutter including a plurality of cutting elements formed of hard metal secured in apertures in the cutter and arranged in circumferential rows on the cutter;

the rows including cutting elements of a first projection alternating with cutting elements of a second projection, the first and second projections being different, wherein each inner row is provided with inserts of first and second differing projections, the cutting elements being formed of hard metal secured by interference fit in apertures in the cutter.

2. An earth-boring bit comprising:

a bit body;

at least one bearing shaft depending inwardly and downwardly from the bit body;

a cutter mounted for rotation on each bearing shaft;

a plurality of hard metal inserts secured in apertures in the cutter by interference fit and arranged in generally circumferential rows on the cutter, the row including a heel row at an outer portion of the cutter and a plurality of inner rows inward of the heel row;

at least one reduced-projection insert disposed between adjacent inserts in at least one inner row, the reduced-projection insert having a projection less than that of the adjacent inserts in the row and wherein the reduced-projection inserts project from the cutter by an amount approximately 60%–80% the amount of the adjacent inserts in the row.

3. An earth-boring bit comprising:

a bit body;

at least one bearing shaft depending inwardly and downwardly from the bit body;

a cutter mounted for rotation on each bearing shaft;

a plurality of hard metal inserts secured in apertures in the cutter by interference fit and arranged in generally circumferential rows on the cutter, the row including a heel row at an outer portion of the cutter and a plurality of inner rows inward of the heel row;

at least one reduced-projection insert disposed between adjacent inserts in at least one inner row, the reduced-projection insert having a projection less than that of the adjacent inserts in the row and wherein the reduce-projection inserts alternate with each adjacent insert in a row.

4. An earth-boring bit comprising:

a bit body;

at least one bearing shaft depending inwardly and downwardly from the bit body;

a cutter mounted for rotation on each bearing shaft;

a plurality of hard metal inserts secured in apertures in the cutter by interference fit and arranged in generally circumferential rows on the cutter, the row including a heel row at an outer portion of the cutter and a plurality of inner rows inward of the heel row;

at least one reduced-projection insert disposed between adjacent inserts in at least one inner row, the reduced-projection insert having a projection less than that of the adjacent inserts in the row and wherein each inner row is provided with reduced-projection inserts alternating with adjacent inserts in a row.

5. An earth-boring bit comprising:

a bit body;

at least one bearing shaft depending inwardly and downwardly from the bit body;

a cutter mounted for rotation on each bearing shaft, the cutter including a plurality of hard metal inserts secured to the cutter and arranged in generally circumferential rows, the rows including a heel row at an outer portion of the cutter and a plurality of inner rows inward of the heel row;

at least one of rows including at least one reduced-projection insert disposed between adjacent inserts.

6. The earth-boring bit according to claim 5 wherein the reduced-projection insert project from the cutter by an amount approximately 60%–80% the amount of the adjacent inserts in the row.

7. The earth-boring bit according to claim 5 wherein the reduced-projection inserts alternate with adjacent inserts in a row.

8. The earth-boring bit according to claim 5 wherein each inner row is provided with reduced-projection inserts alternating with adjacent inserts in a row.

9. The earth-boring bit according to claim 5 wherein the first and second projection inserts are of axisymmetric configuration.

* * * * *